US007897011B2

(12) United States Patent
Peng et al.

(10) Patent No.: US 7,897,011 B2
(45) Date of Patent: Mar. 1, 2011

(54) HIGH QUALITY PAPERBOARD AND PRODUCTS MADE THEREOF

(75) Inventors: Frank Peng, Hammarö (SE); Isto Heiskanen, Imatra (FI); Mika Riikonen, Lappeenranta (FI)

(73) Assignee: Stora Enso AB, Falun (SE)

( * ) Notice: Subject to any disclaimer, the term of this patent is extended or adjusted under 35 U.S.C. 154(b) by 356 days.

(21) Appl. No.: 11/884,225

(22) PCT Filed: Feb. 9, 2006

(86) PCT No.: PCT/EP2006/050814

§ 371 (c)(1),
(2), (4) Date: Apr. 4, 2008

(87) PCT Pub. No.: WO2006/084883

PCT Pub. Date: Aug. 17, 2006

(65) Prior Publication Data

US 2008/0314536 A1 Dec. 25, 2008

(51) Int. Cl.
*D21H 11/10* (2006.01)
*D21H 27/30* (2006.01)

(52) U.S. Cl. ..... 162/129; 162/125; 162/130; 162/141; 162/142; 162/149; 162/150

(58) Field of Classification Search ..... 162/125, 162/127, 129, 130, 141, 142, 149, 150, 26
See application file for complete search history.

(56) References Cited

U.S. PATENT DOCUMENTS

| | | | | |
|---|---|---|---|---|
| 4,913,773 | A | 4/1990 | Knudsen et al. | |
| 5,169,496 | A | 12/1992 | Wagle et al. | |
| 5,603,997 | A | 2/1997 | Lindgren et al. | |
| 6,221,212 | B1 | 4/2001 | Sjoestroem | |
| 6,537,680 | B1 * | 3/2003 | Norlander et al. | 428/532 |
| 2005/0257909 | A1 | 11/2005 | Lindgren et al. | |

FOREIGN PATENT DOCUMENTS

| | | |
|---|---|---|
| EP | 0511185 | 10/1992 |
| FR | 2550993 | 3/1985 |
| GB | 1405006 | 9/1975 |
| WO | WO 9526441 | 10/1995 |
| WO | WO 9902777 | 1/1999 |

OTHER PUBLICATIONS

Grandfeldt et al, Hardwood BCTMP—Improves bulk, smoothness and opacity, Pita,(2003), v.43, No. 7, pp. 43-46. Abstract.*

* cited by examiner

*Primary Examiner*—Eric Hug
*Assistant Examiner*—Peter Chin
(74) *Attorney, Agent, or Firm*—Greer, Burns & Crain, Ltd.

(57) ABSTRACT

The invention relates to a high quality paperboard comprising at least two plies, a first ply having good surface properties and strength, and a second ply for providing the paperboard with bulk wherein the second ply comprises hardwood CTMP. This paperboard has an internal strength and a bending resistance that is comparable with conventional high quality paperboard based on softwood CTMP. The invention also relates to products manufactured of the paperboard.

22 Claims, No Drawings

HIGH QUALITY PAPERBOARD AND PRODUCTS MADE THEREOF

The present invention relates to a high quality paperboard and to products manufactured of it.

BACKGROUND OF THE INVENTION

There are a large number of applications for the use of paperboard. All these applications have their own specific requirements on the paperboard, thus the properties of the paperboard must differ depending on the intended end use.

Paperboard which is to be converted (e.g. coated, printed, cut, creased and folded) on high running automatic machines must have the required strength to withstand the strain and stress created during the converting. Also properties such as flatness and dimensional stability are important during converting. These properties are generally improved by increased bending resistance.

Paperboards used for graphical applications (post cards, brochures, book covers etc) should have high promotion ability. The purpose of this paperboard is generally to convey a message. Since the paperboard itself is part of the message, the appearance of the paperboard is very important. Thus, the paperboard must have good visual appearance, such as high brightness, high smoothness and high cleanliness.

Typical packaging applications for paperboards are dry food (rice, cereal etc), liquids (milk, juice, hot liquids etc), tools (spare parts etc), cigarettes, pharmaceuticals, soap etc. The packages should primarily protect the contents from the surrounding environments, i.e. there is a high protection need. The package must protect the content against impacts during handling, transportation and storing, against the pressure of stacking and extreme temperatures and moisture. Thus, paperboard used for packaging applications must fulfill general strength requirements, e.g. high bending resistance, ply bond and high tear and tensile strength. Also, the demand on print quality of premium consumer goods packages can be as high as that of luxury magazines.

The weight of a paperboard should also be as low as possible, since the cost of transportation must be taken into consideration.

Some goods such as cigarettes, chocolate, drinking water etc, are highly sensitive to taint and odour changes. Packages for such goods must thus secure the flavor of the packed product. The paperboard used must thus have high chemical purity and good values in taint and odour tests. For certain products, for example milk, light can also cause quality deterioration and the paperboard must then provide light barrier capacity.

Table 1 shows examples of important properties for a number of packaging applications.

TABLE 1

Examples of important properties for some special packaging applications.

| Packaging application | Properties needed |
|---|---|
| Deep-frozen food | Strength/toughness, bending resistance, compression strength, taint and odour |
| Cup Stock | Formability, internal sizing and structure against hot liquids, purity, Scott bond, printability, optical appearance |
| Liquid Packaging | Bending resistance, printability, taint and odour, purity, ply bond, optical appearance, internal sizing and structure against liquid penetration, barrier properties |

The highest quality paperboard available is made entirely of chemical pulp, e.g. SBS (solid bleached sulphate). Such paperboard has a very good appearance however needs to have a high grammage in order to give required bending resistance. This kind of solid paperboard is commonly used for packaging of e.g. cigarettes or bottle of liquors. However, packages made from this kind of paperboard are less cost-efficient due to the higher material costs. Not all applications need this extraordinary quality, and thus other paperboard types with different qualities have been developed.

A paperboard generally comprises of 1-5 plies (layers). A paperboard which consists of three or more plies comprises top and back plies, and one or more middle plies. An important property for a high quality paperboard is bending resistance, which is needed to achieve good runnability during converting (e.g. printing, creasing, cutting and forming of the package). High bending resistance promotes good runnability on the packaging machine. Bending resistance is also needed for the protective properties of a package exterior. In packages, high bending resistance promotes rigidity and strength.

Bending resistance is most easily improved by increasing grammage, since higher grammage normally means higher bending resistance. However, an increased grammage is undesirable, due to the increase in cost (cost per package). There is thus an incentive to decrease grammage while maintaining bending resistance.

Normally, chemical pulp is used in the top and back plies of the board, particularly softwood pulp which has good strength properties. The chemical pulp also gives the top and back plies good printing properties. Hardwood pulp may also be added to the outer ply to improve the surface properties. Chemical pulp normally has high purity, which is important in many applications. The middle ply of the board may contain both mechanical pulp and/or chemical pulp. Mechanical pulp, such as CTMP, is a desirable raw material, for one thing because it can be produced to a lower cost than chemical pulp. Also, mechanical pulp has a higher yield and thus a higher efficiency of raw material usage. In high quality boards, softwood CTMP is the most common mechanical pulp used for the middle ply because softwood CTMP in addition to high bulk also has long fibers that can provide good internal bonding. Chemical pulp is normally also used in the middle ply in combination with mechanical pulp, as reinforcement, due to its high strength properties. Paperboard produced based on this concept has thus high bulk with maintained strength.

Because of its ability to combine high bulk and high internal bonding, softwood CTMP is a major raw material in the production of high quality paperboard. Unfortunately, high quality softwood is available only in a limited part of the world and the softwood CTMP supply available for the production of paperboard is not sufficient in relation to the need of high quality paperboard worldwide. The use of softwood CTMP will also be less cost efficient in many countries, due to transportation costs. This is of course a major obstacle in the production of high quality paperboard products.

There is thus a need for a substitute for softwood CTMP that may be used in the production of high quality paperboard. The objective of this invention is therefore to provide a method for manufacturing of high quality paperboard, in which softwood CTMP need not be included, and which has a quality comparable to conventional high quality paperboard. This objective is achieved by the high quality paperboard as defined in claim 1.

SUMMARY OF THE INVENTION

The present invention aims at solving the problem of finding a substitute for softwood CTMP that may be used in the production of high quality paperboard with high bending stiffness. This is achieved by the high quality paperboard of the present invention as defined in claim 1. The high quality paperboard comprises at least two plies: a first ply having good surface properties and strength, and a second ply for providing the paperboard with bulk which second ply comprises hardwood CTMP. This paperboard has an internal strength and a bending resistance that is comparable with conventional high quality paperboard based on softwood CTMP.

The second ply of the paperboard preferably comprises 7-100% by weight of hardwood CTMP and 0-93% by weight of chemical pulp and/or softwood CTMP, all percentages calculated on the total fiber weight of said second ply, whereby a Scott Bond of at least 80 J/m2, a bending resistance index of at least 5 Nm6/kg3 and a z-strength of at least 200 kPa are achieved, thus fulfilling the requirements on high quality paperboard for the manufacture of many different applications.

Even more preferably the second ply comprises 50-90% by weight of hardwood CTMP and 10-50% by weight of chemical pulp and/or softwood CMTP, or most preferably 60-80% by weight of hardwood CTMP and 20-40% by weight of chemical pulp and/or softwood CMTP, all percentages calculated on the total fiber weight of said second ply, thereby achieving a high quality paperboard which is more economically favorable.

The paperboard may further comprise a third ply, arranged in the paperboard such that the second ply is between said first and third ply, in order to obtain a high bending stiffness of the paperboard. The paperboard may comprise further plies between said first and third plies in addition to the second ply. These intermediate plies may have the same or different fiber composition as the second ply. The paperboard may for example comprise four or five plies in total.

The hardwood CTMP of the second ply advantageously comprises eucalyptus CTMP, since eucalyptus is readily available globally, particularly in emerging markets such as Asia and South America and is cost efficient to use.

In one embodiment of the invention the paperboard has a Scott Bond of 120-350 J/m2, a bending resistance index of 8-20 Nm6/kg3, a hexanal value below 600 ppb when measured within one week from the paperboard manufacture and, an EWT (lactic acid) value below 2 kg/m2 and/or an EWT (hydrogen peroxide) value below 2 kg/m2. The paperboard of this embodiment is suitable for use as a liquid packaging paperboard, since it fulfils the demands of paperboard for this purpose.

In another embodiment of the invention, the second ply comprises 7-80% by weight, preferably 20-60% by weight of hardwood CMTP, calculated on the total fiber weight of said second ply. The paperboard of this embodiment has a bending resistance index of at least 5 Nm6/kg3, a Scott Bond value of at least 160 J/m2, a CD stretch to break of at least 2.5%, a hexanal value below 600 ppb when measured within one week from the paperboard manufacture, preferably below 400 ppb, and an EWT (cream coffee) value below 1.8 kg2/m2. The paperboard of this embodiment is suitable for use in the manufacture of cups for holding liquids, since it fulfils the demands of paperboard for this purpose.

In yet another embodiment of the invention, the paperboard has a bending resistance index of at least 5 Nm6/kg3, a Scott Bond value of at least 130 J/m2, a CD stretch to break of at least 2.5% and a hexanal value below 600 ppb when measured within one week from the paperboard manufacture, preferably below 400 ppb. The paperboard of this embodiment is suitable for use as food service board, since it fulfils the demands of paperboard for this purpose.

In a further embodiment of the invention, the second ply of the paperboard comprises hardwood CTMP and the paperboard has a Scott Bond value of at least 80 J/m2, and a brightness (ISO-UV; measured with 420 nm filter) of at least 82% for the uncoated paperboard. The paperboard of this embodiment is suitable for use as a graphical paperboard, since it fulfils the demands of paperboard for this purpose.

In a further embodiment of the invention, the second ply of the paperboard comprises hardwood CTMP and the paperboard has a Scott Bond value of at least 80 J/m2, a hexanal value below 300 ppb, preferably below 200 ppb, when measured within one week from the paperboard manufacture and a brightness (ISO-UV; measured with 420 nm filter) of at least 82% for the uncoated paperboard. The paperboard of this embodiment is suitable for use a cigarette paperboard since it fulfils the demand of paperboard for this purpose.

The invention also relates to a package for holding liquids which is produced from the paperboard of the present invention.

The invention also relates to a package for holding food which is produced from the paperboard of the present invention. In one embodiment the package preferably holds frozen food products.

The invention also relates to a package for holding cigarettes which is produced from the paperboard of the present invention.

The invention also relates to a package for holding pharmaceuticals which is produced from the paperboard of the present invention.

The invention also relates to a package for holding cosmetics which is produced from the paperboard of the present invention.

DETAILED DESCRIPTION

The high quality paperboard of the present invention comprises at least two plies, a first ply which has good surface properties and strength, and a second ply, which provides the paperboard with bulk. The first ply, which may also be referred to as the top ply is made of high density and high elastic modulus raw material, preferably chemical pulp, which gives the product good strength. The first ply also has good printing properties, and provides the product with a printable surface. The second ply of the paperboard may also be referred to as the middle ply, and provides the product with bulk and sufficient strength. According to the present invention the second ply comprises hardwood CTMP. The combination of the first and second plies gives the paperboard high bending resistance. In some preferred embodiments the paperboard comprises a third ply, which may also be referred to as the back ply. The third ply makes it possible to optimize the paperboard structure and still obtain a high bending resistance, for example the bending resistance of the paperboard can be maintained at a high level even if a second ply with lower internal strength is used. The paperboard of the invention may also advantageously comprise one or more plies arranged between the first and third plies. These plies may be referred to as middle plies, together with the second ply. The middle plies may have the same or different composition as the second ply, depending on the desired properties of the paperboard. The paperboard according to the invention is produced according to common knowledge making multi-ply paperboards.

Bending resistance and bending stiffness are related properties, which depend on the modulus of elasticity of the materials and on the thickness of the board. In order to save costs, the target is to manufacture board with minimal amount of raw materials to a maximal thickness. Bending stiffness can be calculated from formulas described in (Deutsche norm DIN 53121:1996-12, formula 5.1.2.2). An common way to optimize raw material usage to get the best bending stiffness, is to use raw material with high density and high elastic modulus in the surface plies (top and back plies) and to use raw materials with high bulk (low density) in the middle ply. The purpose of the middle ply is thus to keep the surface plies at a maximum distance from each other while still maintaining sufficient z-directional rigidity.

A high quality paperboard is a paperboard with high strength, in order to be able to withstand converting, good protective properties as well as high appearance.

Softwood mechanical pulps have hitherto been used for the middle ply in the production of high quality paperboard, since the long and strong fibers of softwood have better internal bonding than the shorter fibers of hardwood, and as a consequence, softwood pulps give a product with high bulk at maintained strength properties.

In the general pursuit of better product quality and cost effectiveness, hardwood CTMP has come into focus because of its good availability globally.

CTMP (chemi-thermomechanical pulp) should be interpreted as a generic term for all kinds of chemimechnical pulps independent of the chemical, temperature and/or pressure used during manufacturing. Thus, the CTMP can for example be: BCTMP, APTMP, APMP, PRC-ATMP, or CMP. The CTMP produced has a yield above 70%, preferably above 75%.

The strength properties of hardwood CTMP are inferior to softwood CTMP for paperboard application. Hardwood CTMP has therefore not been considered as an alternative for use in the middle ply of high quality paperboard, since the purpose of the middle ply is to give bulk at maintained strength of the paperboard.

It has now surprisingly been found that hardwood CTMP can be used as a component of the middle ply in production of high quality paperboard, without any substantial decrease in strength of the final paperboard, as compared with a paperboard having a softwood CTMP middle ply. This result was highly unexpected considering the inferior strength properties of hardwood CTMP. One explanation is that this could be a result of the more uniform structure ply which is formed when using hardwood CTMP, as compared to a ply formed by softwood CTMP.

It was found that the major strength properties of paperboards comprising hardwood CTMP in the middle ply are comparable to the strength properties of reference softwood CTMP paperboards at similar furnish compositions. The essential Scott Bond strength, which has been considered the most probable obstacle when using hardwood CTMP, is obtained at an acceptable level, only marginally lower than that of a reference softwood CTMP containing paperboard. Furthermore, the z-strength of the hardwood CTMP paperboard has surprisingly been found to be at an excellent level, which is even higher than for the reference softwood CTMP containing paperboard despite the fact that z-strength of the hardwood CTMP is lower than that of the softwood CTMP. This demonstrates that the internal strength of the hardwood CTMP paperboard of the invention is very good. Also, the bending resistance index, which is correlated to bending stiffness, is at a good level.

Additional advantages of hardwood CTMP are the good surface and optical properties. When compared with softwood CTMP containing paperboard, the brightness of hardwood CTMP containing paperboard is better, the formation as well as the surface smoothness is better. These advantages are maintained upon calendering of the base board to the desired density. By using hardwood CTMP in the middle ply, the brightness of the paperboard is thus increased. Since hardwood CTMP has better optical properties and provides better formation, the demands on optical properties of the outer plies are decreased, and the top and/or back plies of the paperboard may be made thinner. This is an important aspect in the production of high quality paperboards, since printability and good surface properties are important.

Creasing and folding test has shown that the hardwood CTMP paperboard of the invention behave similarly to reference softwood CTMP boards. When tested with lactic acid solution to simulate the edge penetration in liquid packaging, the hardwood CTMP base boards of the invention show better sizability than the reference softwood CTMP boards.

Apart from good general strength properties (Scott Bond and z-strength) and good surface properties (printing properties and smoothness), a high quality paperboard should have high purity regarding taint and odour. In this aspect hardwood CTMP is advantageous over softwood CTMP, due to the lower extractives content and the lower hexanal value of hardwood CTMP compared to conventional softwood board CTMP, and hence the risks related to taint and odour problems are quite low. The majority of the extractives, especially unsaturated fatty acid components, which is a main cause of hexanal formation, are removed from the hardwood CTMP to a greater extent, as compared to conventional spruce CTMP. This implies good taint and odour properties of the finished paperboard.

The fibers used for the paperboard are typically virgin fibers. Virgin fibers are fibers that never have been used in a product at the customer, in contrast to recycled fibers in waste paper. Internal broke is thus defined as virgin fibers. For paperboard which is intended for use as packages for food and alike, recycled fiber material is normally not permitted. Recycled fiber material is not as clean as virgin fibers and there are restrictions against recycled fiber materials in these kinds of applications. All kinds of hardwood species can be used according to the invention, for example eucalyptus, aspen, poplar, maple or birch. Particularly preferred is eucalyptus CTMP, since it gives good results and is readily available globally, particularly in emerging markets such as Asia and South America and is cost efficient to use.

Hardwood CTMP for use in the production of the paperboard of the invention may have the properties shown below in Table 2.

TABLE 2

| Properties of Hardwood CTMP | |
|---|---|
| CSF (ml) | 200-600 (preferably 300-400) |
| Bulk SCAN (m3/kg) | 2-4 (preferably 2.5-3.5) |
| Tensile index (Nm/g) | 10-60 (preferably 20-50) |
| Tear Index (kPa) | 2-10 (preferably 3-6) |
| Light scatt. Coeff. (m2/kg) | 30-60 (preferably 40-50) |
| Scott-Bond (J/m2) | 20-150 (preferably 40-100) |

TABLE 2-continued

| Properties of Hardwood CTMP | |
|---|---|
| Roughness Bendtsen 0.1 M PA S1 (ml/min) | 500-4000 (preferably 1000-3000) |
| ISO Brightness (%) | 40-90 (preferably 60-80) |

Hardwood CTMP for use in the production of a paperboard holding liquids preferably has the properties shown below in Table 3.

TABLE 3

| Properties of Hardwood CTMP for the production of a paperboard holding liquids | |
|---|---|
| CSF (ml) | 200-600 (preferably 300-400) |
| Bulk SCAN (m3/kg) | 2-4 (preferably 2.5-3.5) |
| Tensile index (Nm/g) | 20-60 (preferably 30-50) |
| Tear Index (kPa) | 2-8 (preferably 3-6) |
| Light scatt. Coeff. (m2/kg) | 30-60 (preferably 40-50) |
| Scott-Bond (J/m2) | 30-150 (preferably 40-100) |
| Roughness Bendtsen 0.1 M PA S1 (ml/min) | 500-4000 (preferably 500-2000) |
| ISO Brightness (%) | above 40 (preferably above 60) |
| Acetone extractives content (%) | below 0.5 (preferably below 0.2) |
| Hexanal (ppb, measured within one week) | below 600 (preferably below 400) |

As stated above, the second or middle layer of the paperboard comprises hardwood CTMP. In addition, it preferably also comprises reinforcement pulp. The reinforcement pulp is usually chemical pulp, of the same type as used in the manufacture of traditional softwood CTMP paperboard. The reinforcement pulp may also be softwood CTMP or a mixture of chemical pulp and softwood CTMP. For the first and optional third plies (top and bottom plies) of the paperboard, hardwood and/or softwood chemical pulp is used, as in traditional softwood CTMP paperboard.

In the case the paperboard consists of more than three plies, e.g. four to five plies, at least one of the middle plies comprises of hardwood CTMP. As an example, the top and back plies of the paperboard may comprise chemical pulp, while the intermediate ply closest to the top ply comprises softwood CTMP, and the ply closest to the bottom ply comprises hardwood CTMP. By carefully choosing the composition of each ply, the properties of the final paperboard may be optimized according to the intended end use.

High quality paperboards are divided into a number of different types, depending on their intended end use. Each application makes different demands on the properties of the paperboard and each paperboard type therefore implies certain characteristics, such as strength properties, internal bonding (Scott Bond (J/m2)), bending resistance index (Nm6/kg3), z-strength (kPa)); taint/odour (hexanal value (ppb)); brightness (ISO)(%); edge penetration; CD (cross direction) stretch to break (%), etc. The different paperboard applications of this invention are therefore characterized by means of parameters, which correspond to their intended end use. The following methods and standards apply both to the definitions of the appended claims and to the measurements performed in the example below.

The edge penetration is a measure of hydrophobicity and sizability and is measured by an edge penetration test—EWT (Edge Wick Test) according to the following method: paperboard samples are covered on both sides with waterproof tape, and cut to a specific size. The samples are conditioned at 23° C., 50% RH for 10 minutes, after which thickness and weight of the samples are measured. Thereafter, the samples are put into a test solution (bath) for a certain period of time: lactic acid (conc. 1%, 1 hour), hydrogen peroxide (conc. 35%, 70° C., 10 minutes), cream coffee (1 1 tap water, 9,5 g instant coffee, 17,5 g dry cream, 80° C., 10 minutes). The wick index for is then calculated by the formula:

$$E = \frac{W2 - W1}{t \times l}$$

where

E=Wick index (kg/m2)

W1=weight before bath (mg)

W2=weight after bath (mg)

t=thickness (μm)

l=total length of the edges of the samples

Hexanal is measured within one week from production of the paperboard according a gas chromatography method, in which a sample is heated in a headspace (Perkin Elmer HS 40XL) to a temperature of 90° C. for 40 minutes, and the gas formed is conducted to the gas chromatograph (AutoSystem XL with a FID), where the components of the sample are separated. The amount of hexanal is measured in ppb (μg/kg).

Formation index is measured according to an internal standard using AMBERTEC Beta Formation Tester.

Bending resistance is measured according to SCAN-P 29:95(L&W 15 degrees).

Bending resistance index (F) is calculated: F=10$\hat{0}$6*Fb/w $\hat{0}$3 (Nm6/kg3), where w=grammage (g/m2) and Fb=bending resistance (mN). The bending resistance index refers to the geometrical bending resistance index, which is calculated F(Geom)=(Fmd*Fcd)$\hat{0}$0.5, where Fmd is the bending resistance index in the machine direction and Fcd is the bending resistance index cross the machine direction.

To assess the convertibility of the paperboard, creasing and folding tests were carried out. For the measurement, 1.3 mm creasing width was used. The sample dimension was 38 mm in width and 50 mm in length. The creasing depth was selected 0, 100 μm and 200 μm plus the paperboard thickness. Folding tests was done using L&W method with a sample length of 10 mm, 120° bending angle and 90°/sec rate.

The following properties are measured according to the standards indicated:

Scott Bond: TAPPI UM-403.

z-directional tensile strength: SCAN-P 80:98

CSF: ISO 5267-2

Bulk (SCAN): ISO 534

Tensile index: SCAN-P 67

Tear index: ISO 1974

Light Scatt Coeff: ISO 9416

Roughness bendtsen: SCAN-P 84

Brightness (ISO): ISO 2470 z-strength: SCAN-P 80

CD stretch to break: SCAN-P 67

Density: ISO 534

According to the invention the second ply (middle ply) preferably comprises 7-100% by weight of hardwood CTMP, calculated on the total fiber weight of the second ply. The remaining fiber material in the ply is chemical pulp and/or softwood CTMP. Depending on the desired end use of the paperboard, the composition of each ply is chosen with regard to the requirements for this particular end use. The second ply preferably comprises 50-90% by weight of hardwood CTMP and 10-50% by weight of chemical pulp and/or softwood CTMP. Even more preferably, the second ply comprises 60-80% by weight of hardwood CTMP and 20-40% by weight of chemical pulp and/or softwood CTMP, resulting in a paperboard which for example is very suitable as folding box board (FBB). The resulting paperboards are all of high quality, having a Scott Bond of 80-400 J/m2, a bending resistance index of 5-20 Nm6/kg3, and a z-strength of 200-500 kPa.

In one preferred embodiment of the invention the paperboard has a Scott Bond of 120-350 J/m2, a bending resistance index of 8-20 Nm6/kg3, a hexanal value below 600 ppb when measured within one week from the paperboard manufacture and an EWT (Edge Wick Test) (lactic acid) value below 2 kg/m2 and/or an EWT (hydrogen peroxide) value below 2 kg/m2. The paperboard of this embodiment has high cleanliness, high strength and good hydrogen peroxide and/or lactic acid penetration values, all which is important for packages containing liquid. It fulfils the demands for use as a liquid packaging paperboard, and is thus suitable for the manufacture of packages for holding liquids, such as milk or juice cartons.

In another embodiment of the invention, the second ply comprises 7-80% by weight, preferably 20-60% by weight of hardwood CMTP, calculated on the total fiber weight of said second ply. The paperboard of this embodiment has a bending resistance index of at least 5 Nm6/kg3, a Scott Bond value of at least 160 J/m2, a CD (cross direction) stretch to break of at least 2.5%, preferably 3.5%, a hexanal value below 600 ppb when measured within one week from the paperboard manufacture, preferably below 400 ppb, and an EWT (cream coffee) value below 1.8 kg2/m2. This paperboard grade has high formation, high cleanliness as well as a good CD stretch value, which fulfils the demands of cup stock paperboard, and is thus suitable for use in the manufacture of cups for holding liquids, such as coffee or other beverages.

In yet another embodiment of the invention, the paperboard has a bending resistance index of at least 5 Nm6/kg3, a Scott Bond value of at least 130 J/m2, a CD stretch to break of at least 2.5%, preferably 3.5% and a hexanal value below 600 ppb when measured within one week from the paperboard manufacture, preferably below 400 ppb. The paperboard of this embodiment has high cleanliness in combination with good strength and CD stretch, and fulfils the demands of food service board, which makes it suitable for use in the manufacture of packages for foodstuff, especially packages in which the foodstuff comes into direct contact with the paperboard.

In a further embodiment of the invention, the second ply of the paperboard comprises hardwood CTMP and the paperboard has a Scott Bond value of at least 80 J/m2, and a brightness (ISO-UV; measured with 420 nm filter) of at least 82% for the uncoated paperboard. The paperboard of this embodiment has good strength and optical properties and fulfils the demands of a graphical paperboard, and is thus suitable for packages holding for example pharmaceuticals or cosmetics.

In another embodiment of the invention, the second ply of the paperboard comprises hardwood CTMP and the paperboard has a Scott Bond value of at least 80 J/m2, a hexanal value below 300 ppb, preferably below 200 ppb, when measured within one week from the paperboard manufacture, and a brightness (ISO-UV; measured with 420 nm filter) of at least 82% for the uncoated paperboard. The paperboard of this embodiment has good strength and optical properties as well as a very good cleanliness and fulfils the demands of a paperboard holding cigarettes.

EXAMPLE

In order to evaluate the high quality paperboard product of the invention, a test series was performed in which hardwood CTMP paperboards of three different compositions were compared with corresponding softwood CTMP paperboards. All paperboards in the test were of a three-ply construction, having top and bottom plies and a middle ply.

Strength, surface properties and folding/creasing properties for the different paperboards were investigated. All tests were performed according to the methods and standards as indicated above and all analyses were carried out according to available standards after conditioning at 23° C., 50% RH.

Pulps

The CTMPs used for the middle ply were euca (eucalyptus) CTMP and spruce CTMP. The properties of both pulps were as conventional, and the most important properties are shown in Table 4.

TABLE 4

Properties of euca CTMP and spruce CTMP.

| | Euca CTMP | Spruce CTMP |
|---|---|---|
| CSF (ml) | 540 | 480 |
| Bulk SCAN (m3/kg) | 3.04 | 2.82 |
| Tensile index (Nm/g) | 24 | 30.2 |
| Tear Index (mNm2/g) | 3 | 10.7 |
| Light scatt. Coeff. (m2/kg) | 42.0 | 36.5 |
| Scott-Bond (J/m2) | 45 | 65 |
| z-strength (kPa) | 102 | 135 |
| Rougness Bendtsen 0.1 M PA S1 (ml/min) | 2506 | 2653 |
| ISO Brightness (%) | 84 | 75 |

As can be seen in Table 4, the largest differences between the two pulps are internal strength (Scott Bond and z-strength), tear strength (tear index), tensile index and optical properties (Light scatt. Coeff and ISO Brightness). The difference in the strength properties can be ascribed the fiber morphology, i.e. that eucalyptus fibers are much shorter and smaller than spruce fibers.

As reinforcement pulps, softwood kraft pulp beated to 25°SR and eucalyptus kraft pulp beated to 35°SR were used. The beating was carried out at a pilot paper machine with a JC00 refiner. For the top and bottom plies were softwood kraft pulp and euca kraft pulp used.

Paperboard

Six three-ply paperboards were produced, each having top and bottom plies, made of kraft furnish and a middle ply, made of a CTMP/kraft furnish in different compositions. The basis weight of the paperboards was approximately 170 gsm with the weight split: top-middle-bottom=34-108-28 g. The top and bottom plies for all paperboards have the same furnish composition: Softwood Kraft/Euca Kraft=30/70.

Strength

Comparative tests were performed on paperboards having a middle-ply containing 60-70-80% spruce CTMP (reference) and paperboards containing 60-70-80% Euca CTMP (invention). Strength properties tested were internal bonding (Scott Bond and z-strength), bending resistance index (which is correlated to bending stiffness) and tear index. The tests were performed before calendering. The bending resistance decreases after calendering. The compositions of the paperboards and their properties before calendering are shown in Table 5.

TABLE 5

Compositions and properties of paperboard before calendering

| Test | Euca CTMP (%) | Spruce CTMP (%) | SW kraft (%) | Euca kraft (%) | Density (kg/m3) | Scott Bond (J/m2) | Bending Resist. index Geom (Nm6/kg 3) | z-strength (kPa) | Tear Index (mN m2/g) |
|---|---|---|---|---|---|---|---|---|---|
| 1 ref | 0 | 80 | 4 | 16 | 412 | 164 | 25.3 | 254 | 13.9 |
| 2 ref | 0 | 70 | 9 | 21 | 429 | 207 | 23.1 | 291 | 14.0 |
| 3 ref | 0 | 60 | 27 | 13 | 489 | 269 | 18.3 | 427 | 14.4 |
| 4 | 80 | 0 | 4 | 16 | 409 | 139 | 32.6 | 277 | 10.3 |
| 5 | 70 | 0 | 9 | 21 | 437 | 173 | 24.9 | 331 | 11.3 |
| 6 | 60 | 0 | 27 | 13 | 469 | 256 | 21.6 | 422 | 12.1 |

The comparison shows that the internal bonding (Scott Bond) for the paperboard of the invention (comprising eucalyptus CTMP) (test No 4-6) is comparable to the internal bonding of the reference paperboard (comprising spruce CTMP) (test No 1-3), which is surprising considering the Scott Bond value of the eucalyptus CTMP per se (cf Table 4). The z-strength is even better for the paperboards comprising eucalyptus CTMP than for the paperboard comprising spruce CTMP.

The paperboard of the invention differs from the reference paperboard in tear strength. However, the difference is smaller than what could have been expected considering the large difference in fiber length of eucalyptus and spruce CTMP pulps.

The bending resistance index value of the paperboard of the invention is even higher than for the reference paperboard. A reason for this may be that the paperboard comprising eucalyptus CTMP has higher bulk than the paperboard comprising spruce CTMP.

Surface Properties

Formation index and surface roughness of the paperboards were measured according to the standard methods previously indicated. Surface roughness is a method of evaluating surface smoothness, which is an important printing parameter. The formation index was measured by grammage variation with Ambertec equipment, which measures small scales basis weight variation.

TABLE 6

Formation index and surface roughness for the paperboards

| Test | Paperboard | Formation index Ambertec Norm. Stdev | Roughness Bendtsen 0.1 MPa S1 (ml/min), accuracy +/− 10% |
|---|---|---|---|
| 1 ref | Spruce 80 | 0.76 | 1813 |
| 2 ref | Spruce 70 | 0.79 | 1653 |
| 3 ref | Spruce 60 | 0.86 | 1928 |
| 4 | Euca 80 | 0.65 | 1337 |
| 5 | Euca 70 | 0.78 | 1729 |
| 6 | Euca 60 | 0.83 | 1895 |

The formation index showed improved formation for paperboards of the invention. The improvement was most significant at the high CTMP charge of 80%.

The surface smoothness of the paperboard of the invention is similar to the surface smoothness of the reference paperboard. The surface becomes rougher with increased charge of reinforcement pulp, possibly due to poorer formation of the long chemical softwood fibers.

Sizability

The sizability (liquid uptake) of the paperboard was studied by the addition of different AKD charges to the middle ply, while keeping the surface sizing (outer plies) constant. EWT (edge wick test) with lactic acid was performed, in the manner previously described. The reference paperboard contained 60% spruce CTMP in the middle ply with an AKD charge of 2.5 kg/ton. The paperboards of the invention contained 60% eucalyptus CTMP with varying AKD charges. All paperboard samples were roll cured, which means the curing takes place while the board is stored in rolls. The lactic acid solution bath had a concentration of 1% and the treatment lasted for 1 hour.

TABLE 7

Liquid uptake for different AKD charges

| Paperboard | AKD charge (kg/t) | EWT lactic acid (kg/m2) |
|---|---|---|
| Spruce 60 (reference) | 2.5 | 0.199 |
| Euca 60 | 1.5 | 0.223 |
| Euca 60 | 2.5 | 0.135 |
| Euca 60 | 3.5 | 0.146 |

At 2.5 kg/AKD charge, the paperboard of the invention shows better sizing results than the corresponding reference paperboard. No further improvement was achieved by increasing the AKD charge.

Folding and Creasing

The compositions of the paperboards tested were 80% respective 60% spruce CTMP in the middle ply and 80% respective 60% eucalyptus CTMP. The compositions of the other plies as well as the grammage of the paperboards were the same as stated above.

TABLE 8

Creasing force and folding moment in CD of the paperboard.

| Paperboard | Creasing depth (mm) | Creasing force (N) | Relative max folding moment (Nm) L&W |
|---|---|---|---|
| Spruce 80 | 0 | 126 | 0.64 |
| Spruce 80 | 100 | 173 | 0.55 |
| Spruce 80 | 200 | 219 | 0.48 |
| Euca 80 | 0 | 118 | 0.65 |
| Euca 80 | 100 | 160 | 0.54 |
| Euca 80 | 200 | 229 | 0.44 |
| Spruce 60 | 0 | 107 | 0.76 |
| Spruce 60 | 100 | 142 | 0.66 |
| Spruce 60 | 200 | 181 | 0.55 |
| Euca 60 | 0 | 109 | 0.76 |
| Euca 60 | 100 | 138 | 0.56 |
| Euca 60 | 200 | 201 | 0.52 |

Creasing test showed that the paperboard of the invention and the reference paperboard behave quite similarly. With increased charge of reinforcement fibers, less force is required to crease the boards to given depth. Folding test after creasing showed that the paperboard of the invention and the reference paperboard spruce behave similarly.

The present invention has been described with regard to preferred embodiments. However, it will be obvious to a person skilled in the art that a number of variations and modifications can be made without departing from the scope of the invention as described herein.

The invention claimed is:

1. A high quality paperboard comprising at least two plies:

a first ply having good surface properties and strength; and a second ply for providing the paperboard with bulk wherein the second ply comprises more than 50% and less than 90% by weight of hardwood CTMP and at least 10% but no more than 50% by weight of chemical pulp, softwood CTMP or a mixture thereof, all percentages calculated on the total fiber weight of said second ply, thereby achieving a Scott Bond of at least 120 J/m$^2$, a bending resistance index of at least 5 Nm$^6$/kg$^3$ and a z-strength of at least 200 kPa.

2. The paperboard of claim 1, wherein the paperboard comprises a third ply, arranged in the product such that the second ply is between said first and third ply.

3. The paperboard of claim 1, wherein the hardwood CTMP of the second ply comprises eucalyptus CTMP.

4. The paperboard of claim 2, for use as a liquid packaging paperboard, having a Scott Bond of 120-350 J/m$^2$, a bending resistance index of 8-20 Nm$^6$/kg$^3$, a hexanal value below 600 ppb when measured within one week from the paperboard manufacture, and an EWT (lactic acid) value below 2 kg/m$^2$ and/or an EWT (hydrogen peroxide) value below 2 kg/m$^2$.

5. The paperboard of claim 2, for use in the manufacture of cups for holding liquids, wherein the second ply comprises a Scott Bond value of at least 160 J/m$^2$, a CD stretch to break of at least 2.5%, a hexanal value below 600 ppb when measured within one week from the paperboard manufacture, and an EWT (cream coffee) value below 1.8 kg$^2$/m$^2$.

6. The paperboard of claim 2, for use as food service board, said paperboard having a Scott Bond value of at least 130 J/m$^2$, a CD stretch to break of at least 2.5%, and a hexanal value below 600 ppb when measured within one week from the paperboard manufacture.

7. The paperboard of claim 2, for use as a graphical paperboard, wherein the paperboard has and a brightness (ISO-UV; measured with 420 nm filter) of at least 82% for the uncoated paperboard.

8. The paperboard of claim 7, for use as a cigarette paperboard, said paperboard having a hexanal value below 300 ppb, when measured within one week from the paperboard manufacture.

9. A package for holding liquids that it is produced from the paperboard of claim 1.

10. A package for holding food that it is produced from the paperboard of claim 1.

11. The package according to claim 10 wherein the package holds frozen food.

12. A package for holding cigarettes that it is produced from the paperboard of claim 8.

13. A package for holding pharmaceuticals that it is produced from the paperboard of claim 1.

14. A package for holding cosmetics that it is produced from the paperboard of claim 1.

15. The paperboard of claim 1, wherein the second ply comprises 60-80% by weight of hardwood CTMP and 20-40% by weight of chemical pulp, softwood CTMP or a mixture thereof.

16. The paperboard of claim 6, wherein said paperboard has a CD stretch to break of at least 3.5%, and a hexanal value below 400 ppb when measured within one week from the paperboard manufacture.

17. The paperboard of claim 3, for use as a liquid packaging paperboard, having a Scott Bond of 120-350 J/m$^2$, a bending resistance index of 8-20 Nm$^6$/kg$^3$, a hexanal value below 600 ppb when measured within one week from the paperboard manufacture, and an EWT (lactic acid) value below 2 kg/m$^2$ or an EWT (hydrogen peroxide) value below 2 kg/m$^2$.

18. The paperboard of claim 3, for use in the manufacture of cups for holding liquids, wherein said paperboard having a Scott Bond value of at least 160 J/m$^2$, a CD stretch to break of at least 2.5%, a hexanal value below 600 ppb when measured within one week from the paperboard manufacture, and an EWT (cream coffee) value below 1.8 kg$^2$/m$^2$.

19. The paperboard of claim 3, for use as food service board, said paperboard having a Scott Bond value of at least 130 J/m$^2$, a CD stretch to break of at least 2.5%, and a hexanal value below 600 ppb when measured within one week from the paperboard manufacture.

20. The paperboard of claim 3, for use as a graphical paperboard, wherein the paperboard has a brightness (ISO-UV; measured with 420 nm filter) of at least 82% for the uncoated paperboard.

21. A high quality paperboard comprising at least three plies:

a first ply having good surface properties and strength;

a third ply; and a second ply in between the first and third plies for providing the paperboard with bulk wherein the second ply comprises more than 50% by weight of hardwood CTMP and less than 50% by weight of chemical pulp, softwood CTMP or a mixture thereof, all percentages calculated on the total fiber weight of said second ply, the paperboard having a Scott Bond of 120-350 J/m$^2$ and a bending resistance index of 8-20 Nm$^6$/kg$^3$.

22. A high quality paperboard comprising at least three plies:

a first ply;

a third ply; and a second ply in between the first and third plies comprising 60-80% by weight of hardwood CTMP and 20-40% by weight of chemical pulp, softwood CTMP or a mixture thereof, all percentages calculated on the total fiber weight of said second ply;

the paperboard having a Scott Bond of 120-350 J/m$^2$, a bending resistance index of 8-20 Nm$^6$/kg$^3$, and a hexanal value below 600 ppb when measured within one week from the paperboard manufacture.

* * * * *